United States Patent [19]

Gillie

[11] Patent Number: 4,514,961

[45] Date of Patent: May 7, 1985

[54] METHOD FOR HANDLING ENVELOPES

[75] Inventor: Raymond A. Gillie, Walnut Creek, Calif.

[73] Assignee: Arvey Corporation, Chicago, Ill.

[21] Appl. No.: 427,492

[22] Filed: Sep. 29, 1982

[51] Int. Cl.[3] ..... B65B 25/14; B65B 43/39; B65B 43/40

[52] U.S. Cl. ..... 53/449; 53/452; 53/458; 53/460; 53/468; 53/491; 229/31 FS; 229/36; 206/602

[58] Field of Search ..... 53/447, 452, 458, 460, 53/468, 475, 491, 492, 449; 229/31 FS, 33, 35, 36; 206/602

[56] References Cited

U.S. PATENT DOCUMENTS

| | | | |
|---|---|---|---|
| 502,952 | 8/1893 | Craw | 229/34 |
| 1,125,902 | 1/1915 | Downey et al. | 229/34 R |
| 1,129,061 | 2/1915 | Binckley | 229/33 |
| 1,609,186 | 11/1926 | Peruzzi | 229/34 |
| 1,732,436 | 10/1929 | Floto | 229/33 |
| 1,941,084 | 12/1933 | Gross | 229/34 R |
| 2,014,695 | 9/1935 | Peterson | 229/34 |
| 2,079,815 | 5/1937 | Ringler | 206/602 X |
| 2,251,565 | 8/1941 | Forman | 229/36 X |
| 2,270,580 | 1/1942 | Christy | 229/36 |
| 2,758,781 | 8/1956 | White | 229/45 |
| 2,916,859 | 12/1959 | Klein | 53/491 X |
| 3,001,685 | 9/1961 | Blount | 229/34 |
| 3,076,589 | 2/1963 | Meijdam | 229/34 |
| 3,139,228 | 6/1964 | Wilkins | 229/34 |
| 3,162,350 | 12/1964 | Miller | 229/34 |
| 3,203,613 | 8/1965 | Stowe | 229/16 |
| 3,581,975 | 6/1971 | Riccio | 229/33 |
| 3,743,170 | 7/1973 | Riccio | 229/33 |
| 3,801,000 | 4/1974 | Hurley | 229/23 R |
| 3,826,420 | 7/1974 | Bamburg | 229/45 |
| 3,889,868 | 6/1975 | Bruckner et al. | 229/34 R |
| 4,196,843 | 4/1980 | Garmon | 229/45 R |

*Primary Examiner*—Horace M. Culver

*Attorney, Agent, or Firm*—Dressler, Goldsmith, Shore, Sutker & Milnamow, Ltd.

[57] ABSTRACT

A method for the handling of unstuffed envelopes which facilitates the subsequent handling of the envelopes stuffed as pre-sorted mail. The unstuffed envelopes are packed into a telescopic carton assembly, which includes first and second cartons having movable flap assemblies that are positioned within the interior of the respective cartons and are movable to positions outside of the respective cartons to convert the cartons into two self-contained containers. The telescopic carton assembly is separated by the mail sender into two cartons and the new unstuffed envelopes are removed therefrom. The movable flap assemblies of the two cartons are moved to positions outside of the interiors of the cartons. The envelopes are stuffed with pre-sorted mail and packed into the two cartons. The movable flap assemblies of the cartons are positioned so as to define the tops of self-contained shipping containers housing the stuffed envelopes for mailing and shipment of the pre-sorted mail.

5 Claims, 6 Drawing Figures

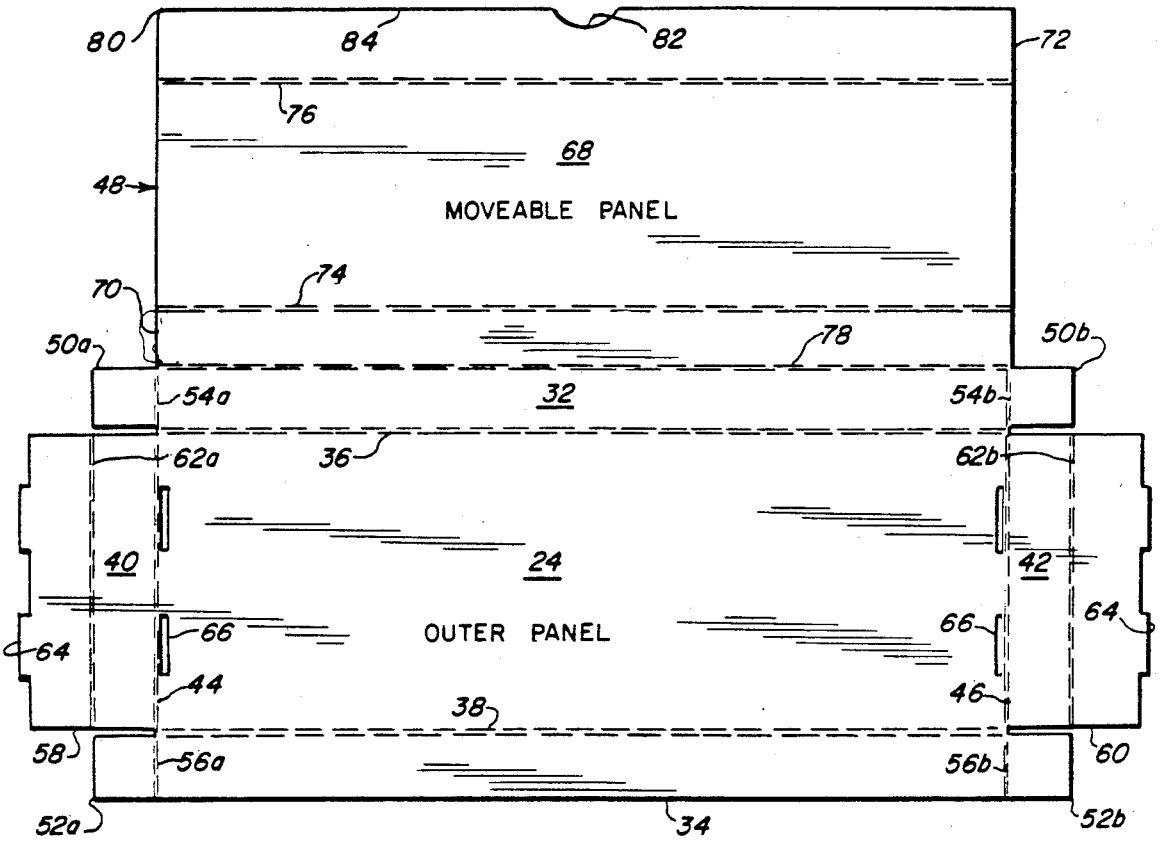
FIG. 4
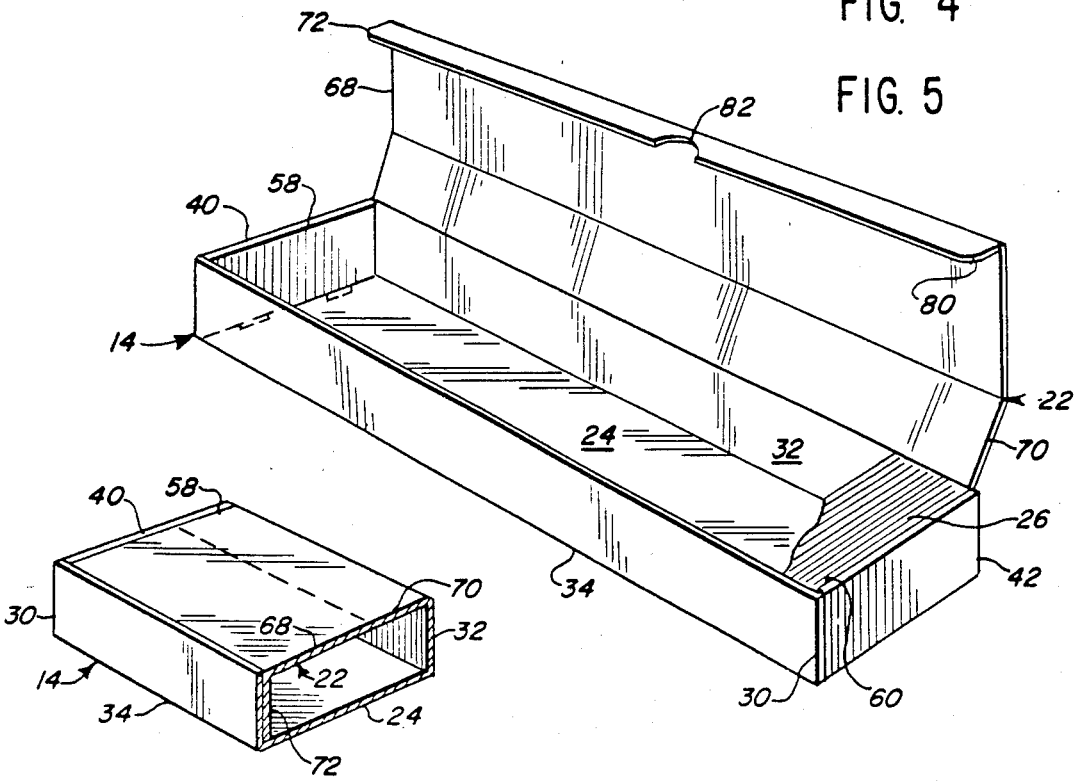
FIG. 5
FIG. 6

METHOD FOR HANDLING ENVELOPES

BACKGROUND OF THE INVENTION

This invention relates to a method for the handling of unstuffed envelopes in a manner which facilitates the subsequent handling of the stuffed envelopes as pre-sorted mail.

Pre-sorted mail and bulk mail are mutually advantageous for the postal service and the sender. The postal service can handle pre-sorted mail and bulk mail more efficiently and expeditiously than mail which has not been pre-sorted and grouped. This results in considerable economic savings to the postal service. To encourage the use of pre-sorted mail, the postal service currently gives a discount in the price of postage per pre-sorted envelope to the economic advantage of the sender.

Usually senders obtain boxes of envelopes for subsequent stuffing from an envelope manufacturer, distributor or supplier. Some of the boxes have top and bottom portions which when separated provide two open top trays in which the envelopes can be removed and stuffed with the material to be mailed.

After the envelopes have been stuffed, the envelopes are often put into different shipping containers for mailing and the original boxes disposed of. This practice is tedious and time consuming and often results in the loss of many man hours in transferring the stuffed envelopes from the original boxes to new shipping containers. Furthermore, this practice results in enormous waste of boxes to the economic detriment of the sender.

Sometimes, the stuffed envelopes are kept in open top trays and the trays are covered for mailing with separate sleeves or lids obtained from vendors or from the postal service. The cost of purchasing these sleeves or lids tends to be very expensive for the sender and/or postal service, especially when voluminous amounts of pre-sorted mail are involved. Furthermore, it is often cumbersome and time consuming to attach the sleeve and lids to the trays.

It is therefore desirable to provide an improved method which makes use of a telescopic carton assembly for delivery of new unstuffed envelopes to the sender, which carton assembly includes first and second cartons which can be readily and easily converted into two self-contained containers into which stuffed and pre-sorted mail can be shipped without purchase of auxiliary sleeves and lids.

SUMMARY OF THE INVENTION

In accordance with the method of the present invention the unstuffed envelopes are placed or packed in a telescopic carton assembly, which includes first and second cartons each having a movable flap assembly that is movable between a position within the interior of the respective carton and a position outside the interior of the respective carton to convert the carton into a self-contained container. The telescopic carton assembly containing the new unstuffed envelopes is delivered to and received by the pre-sorted mail sender, where the envelopes are to be stuffed with pre-sorted mail. The first and second cartons are separated and the new unstuffed envelopes are removed. The movable flap assemblies of the two cartons are moved to positions outside of the interiors of the respective cartons. The envelopes are then stuffed with pre-sorted mail and placed or packed into the two cartons. The movable flap assemblies of the respective cartons are then positioned so as to define the tops of self-contained shipping containers housing the envelopes stuffed with pre-sorted mail.

The method cooperates with a telescopic carton assembly which is particularly useful in connection with the shipment and handling of pre-sorted mail in accordance with the invention. The carton assembly includes two symmetrical interiorly open cartons which telescopically engage each other for delivery of unstuffed envelopes or other articles. When the cartons are telescopically separated from each other, they provide a pair of self-contained shipping containers into which the stuffed and pre-sorted mail or the like can be shipped without the purchase of auxiliary sleeves or lids. Advantageously, the cartons when separated have about twice the load-carrying capacity of the cartons when telescoped into each other.

Each of the cartons has an outer panel which is preferably rectangular. Each carton also has upright walls which are integrally hinged to and extend from the outer panel. Preferably, the upright walls include a pair of opposed longitudinal side flaps and a pair of opposed lateral end flaps.

In order to convert each carton from a telescoping carton into a separated self-contained shipping container, each carton is provided with a movable flap assembly. Desirably, the movable flap assembly has a movable panel and a pair of longitudinal pivotable flaps extending from opposite sides of the movable panel.

In the preferred form, one of the pivotable flaps is integrally hinged to one of the longitudinal side flaps and cooperates with the movable panel to provide the top of the separated self-contained shipping container. The other pivotable panel provides a closure flap for the separated self-contained shipping container and cooperates with the movable panel to provide an interior reinforcement section which is placed against the outer panel within the interior of the carton when the carton is being used as part of the telescopic assembly.

Preferably, each of the cartons can also be erected without the use of glue, gum tape, staples or other auxiliary fasteners. To this end a pair of longitudinally opposed auxiliary side flaps are integrally hinged to each of the longitudinal flaps, and a reinforcing flap is integrally hinged to each of the lateral end flaps. When assembled, the reinforcing flaps are positioned adjacent the lateral end flaps to form pockets for snugly receiving the auxiliary side flaps. This construction provides a generally rigid connection between the longitudinal side flaps and the lateral end flaps. Desirably, each of the reinforcing flaps also has one or more tabs which interlockingly engage tab-receiving apertures or slots in the outer panel to firmly lock the upright walls in an erect position relative to the outer panel.

In the illustrative embodiment, the closure flap has a finger grippable arcuate portion along its outer edge to provide an arcuate access opening for ease of gripping and moving the closure flap.

A more detailed explanation of the improved method of the invention is provided in the following description and appended claims taken in conjunction with the accompanying drawings.

BRIEF DESCRIPTION OF THE DRAWINGS

FIG. 4 is a top plan view of a blank or web from which the upper or lower carton is formed;

FIG. 5 is a perspective view of one of the cartons separated from the other carton with stuffed and pre-sorted mail therein and depicting the movable flap assembly of that carton in an open position prior to use of that carton as a self-contained shipping container; and FIG. 6 is a fragmentary perspective view of portions of the self-contained shipping container as closed for mailing.

DETAILED DESCRIPTION OF THE INVENTION

The discussion of the method of the present invention which hereinbelow follows is made in conjunction with a discussion and disclosure of a presently considered preferred embodiment of the telescopic carton assembly.

Figure 1:
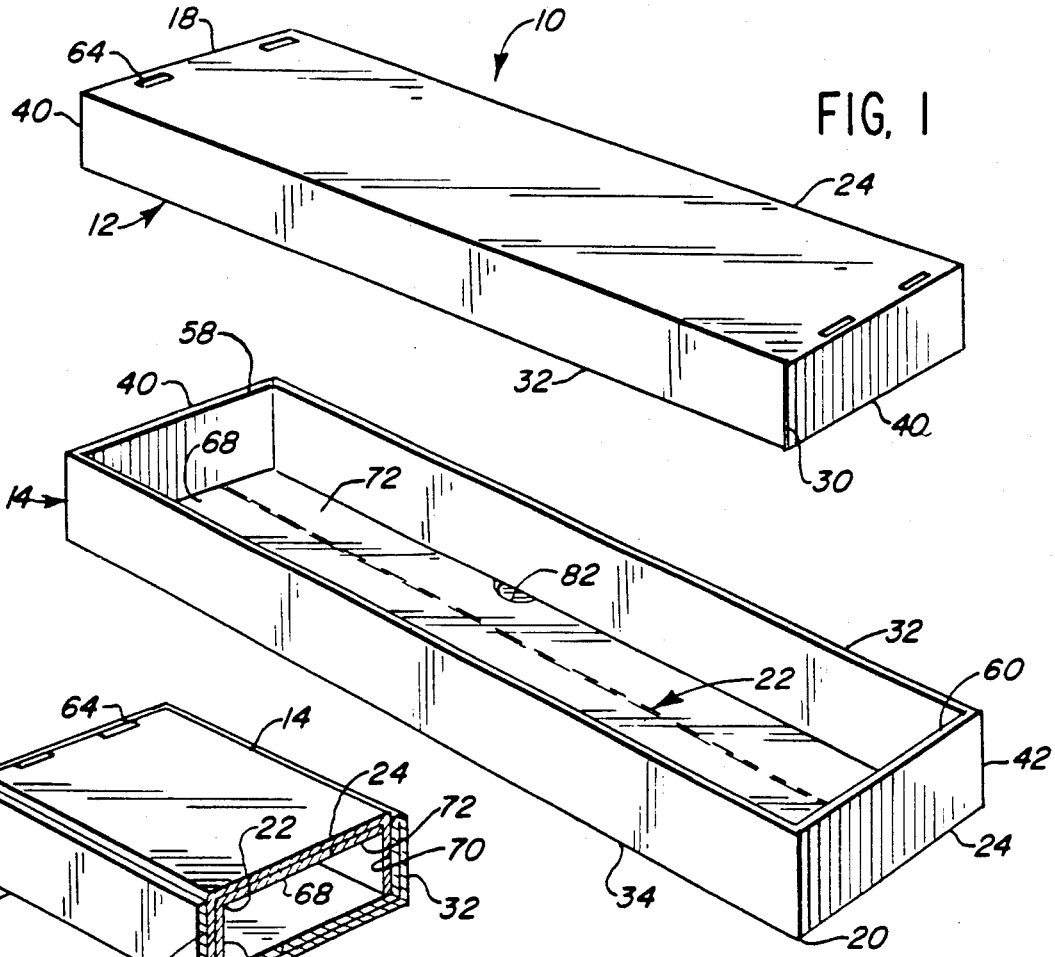
FIG. 1 is an exploded perspective view of a telescopic carton assembly for use in cooperation with the method of the present invention.
Figure 2:
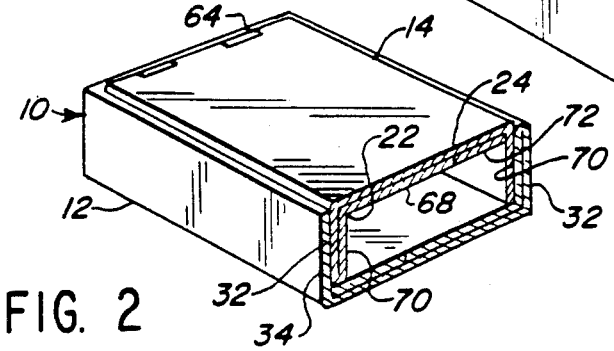
FIG. 2 is a fragmentary perspective view of a portion of the telescopic carton assembly shown in FIG. 1 illustrating portions of the upper and lower cartons in telescopic engagement with each other.
Figure 3:
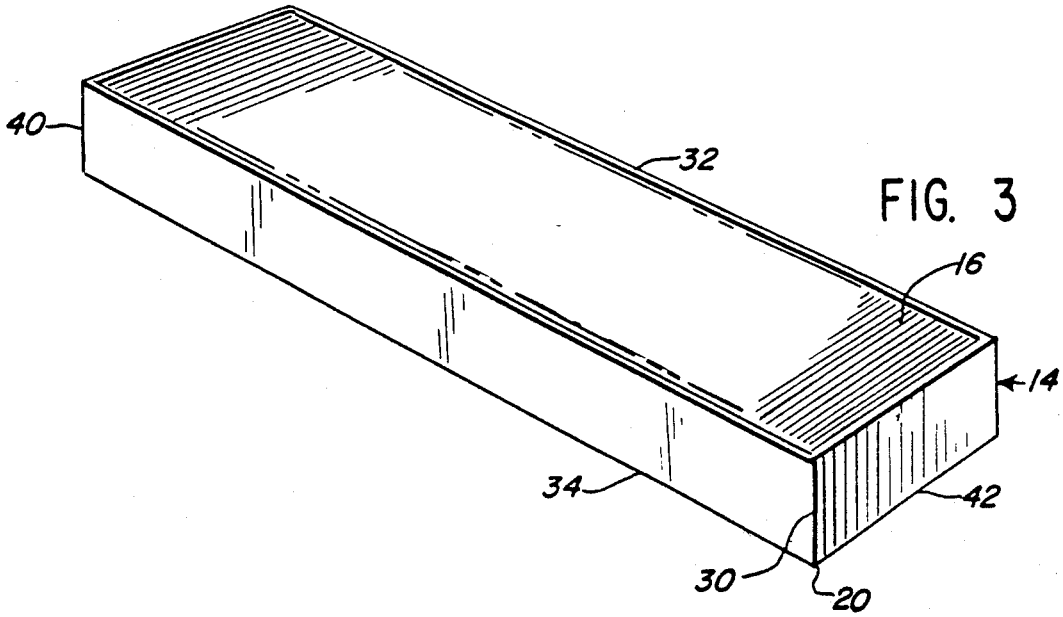
FIG. 3 is a perspective view of one of the cartons of the telescopic carton assembly illustrated in FIG. 1 packed with envelopes ready to be stuffed.

FIGS. 1–3 of the drawings illustrate a telescopic carton assembly 10 for use in cooperation with the method of the present invention. Assembly 10 includes an upper carton 12 and a lower carton 14. Upper and lower cartons 12 and 14 are generally symmetrical, complementary and structurally similar to each other. In the illustrative embodiment the upper carton 12 is of a slightly larger size than the lower carton 14 for telescopically receiving and covering the lower carton 14. In some circumstances, it may be desirable that the lower carton 14 be slightly larger in size than the upper carton 12 to telescopically receive and peripherally surround portions of the upper carton 12.

Telescopic carton assembly 10 is particularly useful for delivery of new, unused empty envelopes 16 (FIG. 3). Telescopic carton assembly 10 can also be useful for shipping other articles and materials.

When the envelopes 16 (FIG. 3) arrive at the pre-sorted mail sender in the closed telescopic carton assembly 10 (FIG. 2), the sender will open the carton assembly 10 and separate the cartons 12 and 14 so that the upper carton 12 is positioned upside down or inverted with its top 18 juxtapositioned closely adjacent the bottom 20 of the lower carton 14 to provide a pair of "open top" trays or compartments from which the envelopes 16 are removed for subsequent stuffing with material to be mailed.

As shown in FIG. 1, each of the cartons 12 and 14 has a movable flap assembly 22 which serves as an interior reinforcement section or portion for positioning against the inner surface of the outer panel 24 within the interior of the carton 12 and 14 so that the cartons 12 and 14 form a pair of interiorly open chambers which face each other when telescopically engaged into each other.

After the new envelopes 16 have been removed, removable flap assembly 22 of each carton 12 or 14 is moved to an open position such as shown in FIG. 5 for placement, stuffing and sorting of the envelopes as pre-sorted mail 26. After the cartons 12 and 14 are filled with pre-sorted mail, the movable flap assembly 22 of each carton 12 and 14 is moved or pivoted to a closure position as shown in FIG. 6 to provide a pair of self-contained shipping containers for mailing and shipment of the pre-sorted mail 26.

Typically, the envelopes 26 (FIG. 5) after being stuffed with the material to be mailed occupy about twice the space of the unstuffed empty envelopes 16 (FIG. 3) delivered in the telescopic carton assembly 10 (FIGS. 1 and 2). Advantageously, the combined load-carrying capacity of the two separated self-contained shipping containers is about twice the load-carrying capacity of the cartons 12 and 14 when telescoped into each other.

After the pre-sorted mail in the self-contained shipping containers (FIG. 6) have been mailed and the pre-sorted mail 26 removed, the cartons 12 and 14 can once again be telescopically inserted into each other to form a relatively compact telescopic carton assembly 10 (FIG. 2) which occupies about one-half the storage space of the separated cartons or self-contained shipping containers 12 and 14 (FIG. 6).

Each of the cartons 12 and 14 are made of corrugated cardboard. Preferably, each of the cartons 12 and 14 are also coated or impregnated with a liquid impervious material so that the cartons 12 and 14 will not generally weaken or decompose when exposed to rain or snow. In some circumstances it may be desirable that the cartons be made of other materials, such as paperboard or plastic.

In the illustrative embodiment, each of the cartons 12 and 14 is of a height and width to comfortably receive No. 10, standard letterhead or business envelopes 16 (FIG. 3). Other size cartons can also be used.

In detail, each of the cartons 12 and 14 has a generally rectangular outer panel 24 with generally upright walls 30. Outer panel 24 (FIG. 1) provides the top and bottom of cartons 12 and 14, respectively, when the cartons 12 and 14 are telescoped into each other.

Upright walls 30 include a pair of laterally opposed, elongated, rectangular, longitudinal side flaps 32 and 34 (FIG. 4). One of the side flaps 32 provides a side panel which extends from and is integrally hinged to the outer panel 24 along a first longitudinal scoreline or longitudinal edge 36 and the other side flap 34 extends from and is integrally hinged to the outer panel 24 along a laterally opposite second longitudinal scoreline or longitudinal edge 38. Upright side walls 30 also have a pair of longitudinally opposed, elongated, generally rectangular, lateral end flaps or panels 40 and 42 which are integrally hinged to and extend from the outer panel 24 along lateral scorelines or edges 44 and 46, respectively.

In order to securely erect the blank or web 48 (FIG. 4) into a generally rigid carton or container 12 and 14 without the use of glue, gum tape, staples or other auxiliary fasteners, the upright walls 32 have a pair of auxiliary interlocking side flaps **50*a* and 50*b*, and 52*a* and 52*b*, integrally hinged to and extending from longitudinal side flaps 32 and 34 along laterally opposite scorelines 54*a*, 54*b*, 56*a* and 56*b*, respectively. Upright walls 30 also have auxiliary inner reinforcement end flaps 58 and 60 extending from and integrally hinged to the ends of the lateral end flaps 40 and 42 along lateral scorelines 62*a* and 62*b***, respectively.

When assembled, the auxiliary end flaps 58 and 60 are positioned within the interior of the cartons 12 and 14 along the inwardly facing surfaces of the lateral end flaps 40 and 42, respectively, and face each other. Auxiliary end flaps 58 and 60 cooperate with the lateral end flaps 40 and 42 to define lateral, internal auxiliary side flap-receiving pockets which snugly receive auxiliary side flaps 50*a*, 50*b*, 52*a* and 52*b* to form a generally rigid connection between the longitudinal side walls 32 and 34 and the lateral end walls 40 and 42.

In order to securely attach and lock the upright walls 30 to the outer panel 24 without the use of auxiliary fasteners, such as staples, gum tape, etc., each of the auxiliary end flaps 58 and 60 has at least one and preferably two laterally spaced locking tabs 64 (FIG. 4). Outer panel 24 has a pair of aligned laterally opposed tab-receiving slots or apertures 66 positioned closely adjacent lateral scorelines 44 and 46, respectively. Tab-receiving slots 66 receive and interlockingly engage locking tabs 64.

In the illustrative embodiment tab receiving slots 66 are generally rectangular in shape and complementary in size to the tabs 64. Other shapes and configurations can be used if desired.

Each of the cartons 12 and 14 has a movable flap assembly 22 for converting the carton 12 or 14 from a portion of the telescopic carton assembly 10 (FIGS. 1 & 2) to a self-contained shipping container (FIG. 6) when telescopically separated from the other carton. As best shown in FIGS. 4 and 5, each movable flap assembly 22 has a generally rectangular movable panel 68 and a pair of elongated generally rectangular longitudinal pivotable flaps 70 and 72 extending along and integrally hinged to opposite longitudinal sides of the movable panel via longitudinal scorelines 74 and 76, respectively.

Pivotable flap 70, which is also referred to as the "inner pivotable flap" also extends from and is integrally hinged to longitudinal side flap 32 via longitudinal scorelines or edge 78 (FIG. 4). Preferably, inner pivotable flap 70 is generally of the same size and shape as longitudinal side flap 32 and is movable or pivotable to a side flap-engaging position bearing against the inner surface of longitudinal side flap 32 within the interior of the carton 12 or 14 as part of the telescopic carton assembly 10 (FIGS. 1 & 2).

Inner pivotable flap 70 and movable panel 68 together are about the same size and shape as the outer panel 24 as viewed from the interior of the carton 12 or 14 and are movable together to a closure position as shown in FIG. 6 to provide the top of the carton 12 or 14 during use of the carton 12 or 14 as a separated self-contained shipping container (after the cartons 12 and 14 have been telescopically separated from each other).

The outer pivotable flap 72 is generally of the same size as the other longitudinal side flap 34 and provides a closure flap that can be moved or pivoted to a closure position, as shown in FIG. 6, to bear against the inner surface of longitudinal side flap 34 during use of the carton 12 or 14 as a separated self-contained shipping container (after the cartons 12 and 14 have been telescopically separated from each other).

Outer pivotable flap 72 and movable panel 68 are movable or pivotable together to an outer panel-engaging position, as shown in FIGS. 1 and 2, so as to bear against and engage the inner surface of outer panel 24 when the cartons 12 and 14 are being used as part of the telescopic carton assembly 10. Preferably, the outer pivotable flap 72 and the movable panel 68 together occupy about the same interior surface area as the outer panel 24.

In the preferred embodiment, the outer corners 80 (FIGS. 4 and 5) of the outer pivotable flap 72 are rounded to minimize frictional interference with the upright walls 30 of the carton 12 or 14 when the flap assembly 22 is being moved into and out of the closure and outer panel-engaging positions, respectively.

Preferably, outer pivotable flap 72 also has an arcuate finger-gripping section 82 (FIGS. 4 and 5) positioned generally midway along its outer edge 84. Arcuate finger-gripping section 82 defines an arcuate access opening to facilitate gripping of the outer pivotable flap 72. In the illustrative embodiment the arcuate section 82 is concave and preferably semi-circular in shape.

Although the method of the present invention is disclosed in cooperation with a preferred embodiment of the telescopic carton assembly, it is to be understood that various alternative embodiments of the carton assembly may be used by those skilled in the art without departing from the novel spirit and scope of the method of the invention.

What is claimed is:

1. A method for the handling of unstuffed envelopes in a manner which facilitates the subsequent handling of the stuffed envelopes stuffed as pre-sorted mail, comprising the steps of:

(a) providing a telescopic carton assembly having a first carton and a second carton for telescopically receiving the first carton, wherein each of the first and second cartons are self-contained shipping containers having an outer panel providing a bottom for the carton, upright walls extending generally upwardly around the outer panel, and converting means for converting the carton from use as a separate self-contained shipping container to use as a carton as part of the telescopic carton assembly;

(b) placing unstuffed envelopes in the telescopic carton assembly for shipment of the unstuffed envelopes;

(c) separating the first carton from the second carton;

(d) removing the unstuffed envelopes from the first and/or second cartons;

(e) positioning the converting means of the first and second cartons to positions outside of the interiors of the respective first and second cartons;

(f) stuffing and sorting the envelopes as pre-sorted mail;

(g) placing a first portion of the envelopes stuffed as pre-sorted mail in the first carton and a second portion of the envelopes stuffed as pre-sorted mail in the second carton; and (h) positioning the converting means of the first and second cartons so as to define the tops of self-contained shipping containers housing the stuffed envelopes for shipment of the pre-sorted mail.

2. A method for the handling of unstuffed envelopes in a manner which facilitates the subsequent handling of the envelopes stuffed as pre-sorted mail, comprising the steps of:

(a) providing a telescopic carton assembly having a first carton, a second carton for telescopically receiving the first carton, wherein each of the first and second cartons are self-contained shipping containers having an outer panel providing a bottom for the carton, upright walls extending generally upwardly around the outer panel, and a movable flap assembly integrally hinged to and extending from one of the upright walls for converting the carton from use as a separate self-contained shipping container wherein the movable flap assembly defines the top of the separate self-contained shipping container to use as a carton as part of the telescopic carton assembly wherein the movable flap assembly is positioned within the interior of the carton;

(b) by placing unstuffed envelopes in the telescopic carton assembly for shipment of the unstuffed envelopes;

(c) separating the first carton from the second carton;

(d) removing the unstuffed envelopes from the first and/or second cartons;

(e) moving the movable flap assemblies of the first and second cartons to positions outside of the interiors of the respective first and second cartons;

(f) stuffing and sorting the envelopes as pre-sorted mail;

(g) placing a first portion of the envelopes stuffed as pre-sort-ed mail in the first carton and a second portion of the envelopes stuffed as pre-sorted mail in the second carton; and (h) positioning the movable flap assemblies of the first and second cartons so as to define the tops of self-contained shipping containers housing the stuffed envelopes for shipment of the pre-sorted mail.

3. A method for the handling of unstuffed envelopes in a manner which facilitates the subsequent handling of the envelopes stuffed as pre-sorted mail, comprising the steps of:

(a) providing a telescopic carton assembly having a first carton, and a second carton for telescopically receiving the first carton, wherein each of the first and second cartons are self-contained shipping containers having an outer panel providing a bottom for the carton, upright walls extending generally upwardly around the outer panel, and a movable flap assembly integrally hinged to and extending from one of the upright walls for converting the carton from use as a separate selfcontained shipping container wherein the movable flap assembly defines the top of the separate self-contained shipping container to use as a carton as part of the telescopic carton assembly wherein the movable flap assembly is positioned within the interior of the carton;

(b) placing unstuffed envelopes into one of the first and second cartons;

(c) positioning the other one of the first and second cartons with its movable flap assembly within the interior thereof over the carton containing the unstuffed envelopes in telescoping relationship thereto for shipment of the unstuffed envelopes;

(d) separating the first carton from the second carton;

(e) removing the unstuffed envelopes from the first and/or second cartons;

(f) moving the movable flap assemblies of the first and second cartons to positions outside of the interiors of the respective first and second cartons;

(g) stuffing and sorting the envelopes as pre-sorted mail:

(h) placing a first portion of the envelopes stuffed as pre-sorted mail in the first carton and a second portion of the envelopes stuffed as pre-sorted mail in the second carton; and (i) positioning the movable flap assemblies of the first and second cartons so as to define the tops of self-contained shipping containers housing the stuffed envelopes for shipment of the pre-sorted mail.

4. The method as defined in claim 3 wherein the movable flap assembly includes a movable panel and first and second pivotable flaps which are respectively integrally hinged to and extend along generally opposite edges of the movable panel.

5. The method as defined in claim 4 wherein the movable panel and the second pivotable flap of each of the first and second cartons have dimensions no greater than the dimensions of the corresponding outer panel.

* * * * *